US005222702A

United States Patent [19]

Olmos

[11] Patent Number: 5,222,702

[45] Date of Patent: Jun. 29, 1993

[54] STRIP FOR HOLDING PLASTIC BAGS

[76] Inventor: Jesse G. Olmos, 2041 Brentwood, Houston, Tex. 77019

[21] Appl. No.: 872,045

[22] Filed: Apr. 23, 1992

Related U.S. Application Data

[63] Continuation of Ser. No. 675,297.

[51] Int. Cl.[5] ..... B65B 67/12

[52] U.S. Cl. ..... 248/95; 248/100

[58] Field of Search ..... 248/95, 97, 100, 101; 53/384, 390; 141/316, 390, 391

[56] References Cited

U.S. PATENT DOCUMENTS

| | | | |
|---|---|---|---|
| 3,912,208 | 10/1975 | Grenetier | 248/101 X |
| 4,062,170 | 12/1977 | Orem | 53/390 |
| 4,223,858 | 9/1980 | Salazar | 248/101 |
| 4,669,689 | 6/1987 | Jones | 248/152 X |
| 4,705,249 | 11/1987 | Edwards | 248/101 |
| 4,881,706 | 11/1989 | Sedlik | 248/150 X |
| 4,915,330 | 4/1990 | Buckley | 248/99 |
| 4,997,149 | 3/1991 | Koch | 220/404 X |
| 4,998,694 | 3/1991 | Barteaux | 248/100 |
| 5,002,245 | 3/1991 | Hansen | 248/101 X |

FOREIGN PATENT DOCUMENTS

| | | | |
|---|---|---|---|
| 2437326 | 2/1976 | Fed. Rep. of Germany | 248/99 |
| 119949 | 10/1947 | Sweden | 248/101 |

*Primary Examiner*—J. Franklin Foss

*Attorney, Agent, or Firm*—James L. Jackson

[57] ABSTRACT

A strip is provided for horizontal mounting on a vertical planar surface for holding the straps or handles of a plastic bag in upper edge notches of the strip located respectively near either end. Standoff pads are normally employed on the back of the strip toward the center from the respective notches to permit the bag straps or handles to easily slip into the notches. The notches are sized to wedge the straps so that they can be held near the back edge of the opening of the bag, which causes the bag to tilt forward in an open condition.

16 Claims, 1 Drawing Sheet

FIG.1
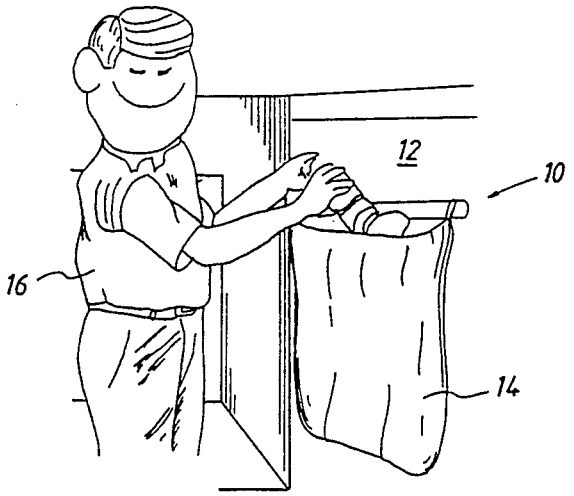
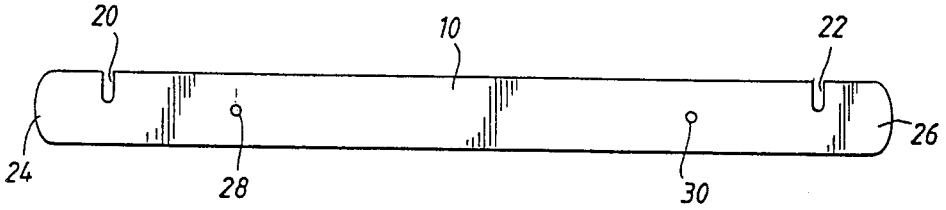
FIG.2
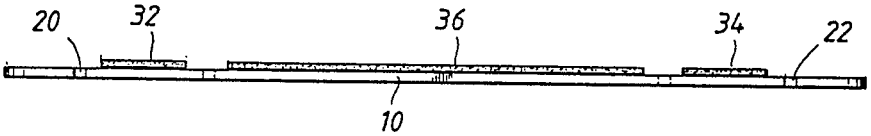
FIG.3
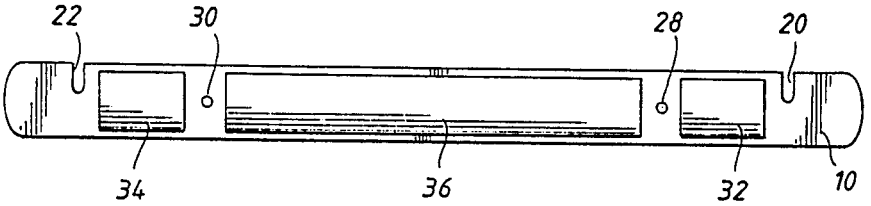
FIG.4
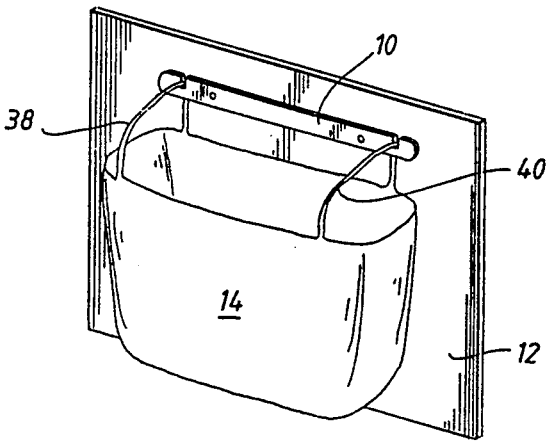
FIG.5

STRIP FOR HOLDING PLASTIC BAGS

This is a continuation of application Ser. No. 07/675,297, filed Mar. 26, 1991 now abandoned.

BACKGROUND OF THE INVENTION

1. Field of the Invention

This invention pertains to a holder for holding a plastic bag or sack and in particular to a holding strip particularly suited for holding and, therefore, permitting the convenient reusing of the kind of small plastic bag that is often provided to shoppers.

2. Description of the Prior Art

It has long been recognized that plastic bags are not self-supporting and, therefore, must always be used in conjunction with some kind of means that holds them open during use. Probably, most of the time, this is the user, who holds the bag open with one hand while filling it with refuse with the other. Large garbage bags and even plastic liners for waste baskets are commonly held open for use, respectively, by the garbage can or the waste basket with which they are placed in service. The top of the bag is usually folded back around the rim of the container to hold the bag open. The depth of the bag is usually greater than the depth of the container so that it is really the bottom of the container, and not the bag, that supports the garbage or waste as the bag is filled.

Containers are not the only auxiliary supporting structure used with bags, however. Leaf bags or lawn bags used for grass clippings and the like are often supported by a frame-and-stand arrangement. In such a structure, the top of a bag is folded over the frame and an elastic band is placed over the folded top edge to secure it to the frame. The bag usually is sufficiently deep to rest on the bottom of the frame so that when the bag is loaded there is little extra weight put on the frame by the bag. Therefore, the bag does not pull free.

Recent structures that have appeared in the patent art include a garbage bag holder comprising a plastic molding with integral hinge webs connecting with the ends of linked U-shape frame members (U.S. Pat. No. 4,537,377, Shewchuk); a frame for a leaf-collecting bag having a rectangular frame with legs holding it upright, the frame being provided with clips for attaching the bag at the frame corners (U.S. Pat. No. 4,759,519, Cheng); and trash can adaptor ring and clip for securing a plastic bag within a trash can, the ring including multiple spikes for hooking over the bag (U.S. Pat. No. 4,925,056, McCoig). None of these prior art structures really address the needs solved by the present invention, however.

Shoppers at the grocery store, hardware store, drug store and the like are often provided small plastic bags at the check out counter in which to take home their purchases. Such a plastic shopping bag includes handles to allow the shopper to carry his or her purchases without having to support the bag from underneath, as with the paper sacks that have been in use for quite some time. When the shopper arrives home and unloads and puts away the contents that were carried home in the sack, the sack is generally discarded or thrown away.

Occasionally, someone may reuse such a sack by looping one or both handles of the sack over a convenient door knob or cabinet knob. The reason that this is not done more often, however, is that the sack is not really conveniently held open, requiring that two hands be used to discard something into the sack. Moreover, it is inconvenient to have a sack attached to a door or a drawer or the like that swings to and fro every time the door is opened or closed or the drawer is used. Nevertheless, it is apparent that such sacks are not worn out by being used just once for carrying purchases home from the store. And, the size of these sacks does make them desirable for small accumulations of light waste that might occur in a bathroom, bed room, shop, boat, recreational vehicle or the like.

It has been observed that some stores that provide these small plastic bags at their checkout counters do have wire racks or the like over which the plastic straps are looped to make is convenient for the sacker to take one from the rack when needed. Such racks are suitable for dispensing plastic bags, but they do not hold the bags open to assist loading. In any event, the structure of the racks with holding arms and the like are not acceptable for home or other personal use as described hereafter for the present invention.

Therefore, it is a feature of the present invention to provide an improved holder for a small plastic bag with handles or straps that conveniently holds such bag in an open position for use.

It is another feature of the present invention to provide such an improved holder that allows one to quickly and easily use for holding a small plastic bag and for removing such a bag when it is full.

If is still another feature of the present invention to provide an improved holder for a plastic bag that takes little space by itself so that when a bag is not being held the appearance of the holder is very unobtrusive.

SUMMARY OF THE INVENTION

The inventive holder generally includes an elongate strip that is somewhat flexible and which is normally slightly longer than the side of an open bag that it holds. Typically, such a strip is made of plastic material, but it may be made of metal or even wood. Near each end of the strip is a notch in the top edge for accommodating a respective one of the straps of the bag. Thus, the notches are spaced apart approximately the same distance that the straps are spaced apart.

The strip includes two screw holes for attaching to a wood surface by wood screws or to a sheetrock surface by molly bolts. Alternatively, a double sided adhesive tape is provided for attaching the strip to any type of surface to which such a strip can be attached, for example, the side of a metal cabinet.

In a preferred embodiment, two standoff cushion pads are attached to the back of the strip, one near each end between the respective notch and the nearest screw hole. Such pads space the respective ends slightly away from the mounting surface so that the bag straps can easily be manipulated over the strip ends into the notches. Preferably also, the notches are dimensioned in width to snugly or wedgedly secure the straps so that the straps will not slip when they are positioned off center with respect to the bag opening. This allows the bag straps to be positioned within the notches and to stay put so as to tilt the bag open in a slightly forward direction, rather than to close up.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the exemplary preferred embodiment thereof which is illustrated in the drawings, which form a part of this specification. It is to be noted, however, that the appended drawings illustrate only a typical preferred embodiment of the invention and are not to be considered limiting of its scope as the invention may admit to other equally effective embodiments. In the drawings:

FIG. 1 is a pictorial drawing of a preferred embodiment of the invention in use.

FIG. 2 is a front view of a preferred embodiment of the invention.

FIG. 3 is a top view of the embodiment shown in FIG. 2.

FIG. 4 is a rear view of the embodiment shown in FIG. 2.

FIG. 5 is an isometric view of the invention in use with a typical plastic bag.

DESCRIPTION OF THE PREFERRED EMBODIMENT

Now referring to the drawings, and first to FIG. 1, a pictorial view is shown of a location where strip holder 10 is typically employed. In this illustration, holder 10 is affixed in a substantially horizontal plane to an available vertical planar surface 12 such that held bag 14 is at a convenient level for easy access by user 16. The bag is suitable for the accumulation of light weight refuse in the form of paper, aluminum cans and the like.

Strip 10 is more completely shown in FIGS. 2, 3 and 4. A typical strip is 12 inches long, one inch wide, and ⅛ inch thick. At a location of one inch from the respective ends of the strip, upper edge 18 is notched at notches 20 and 22. Each notch is typically one-eighth inch wide and three-eighth inch deep for functional purposes explained hereafter. Ends 24 and 26 are preferably slightly rounded so that the straps of the bags that are slipped over them will not snag or bind.

Mounting screw holes 28 and 30 are located respectively 2¼ inches from their respective ends, thereby placing them toward the center of the strip from notches 20 and 22, respectively. The screw hole placement, however, is not critical, as will be apparent, so long as they are located toward the center of the strip from notches 20 and 22.

As shown in FIGS. 3 and 4, small standoff pads 32 and 34 are located respectively between notch 20 and screw hole 28 and notch 22 and screw hole 30. Typically, such pad is a soft material, such as neoprene or the like, and is affixed to the strip by a suitable adhesive. A typical standoff pad is about one-sixteenth inch thick.

Also affixed to the back of strip 10 can be an adhesive strip 36, which is located between pads 32 and 34. Such strip is a double sided adhesive strip so that the protected side of the adhesive strip not attached to strip 10 can be peeled off for mounting strip 10 as an alternate mounting means to screw holes 28 and 30. For example, it may be desirable to mount the strip on a metal surface or it may be desirable to mount the strip in such a manner so as not to leave permanent screw holes.

Alternatively to having a separate adhesive strip 36, pads 32 and 34 can each have an outside adhesive surface for mounting purposes. In this event, the protective paper is merely peeled from each of these pads and the strip placed in position and pressed firmly to the vertical planar mounting surface. Regardless of whether a separate strip 36 is used or pads 32 and 34 are used, the strip is mounted by whichever means inside of notches 20 and 22 so as to leave ends 24 and 26 free and slightly separated from the mounting surface by the thickness dimension of pads 32 and 34.

A plastic bag 14 with which strip holder 10 is employed is normally less deep than garbage leaf bag and is of lighter weight material. Nevertheless, the bags are strong and tough enough for carrying purchases home from the store by handles or straps 38 and 40 either manufactured as part of bag 14 or securely attached thereto. Such handles are normally about 10 inches apart, although handles or straps not so far apart or even slightly further apart can be used with notches 20 and 22 in a strip 10 separated by 10 inches. In use, the handles are slipped over the respective ends of strip 10, which, it may be recalled, are spaced slightly away from mounting surface 12. Preferably, strip 10 is also somewhat flexible to permit a slight pulling forward of the strip to allow the straps of bag 14 to be slipped over the strip ends more easily.

The straps are placed in notches 20 and 22, respectively, not too far from where the straps connect to the open end of bag 14. This permits the front edge of the open end of the bag to tilt forward and away from mounting surface 12 and to remain conveniently open for use. Notches 20 and 22 are conveniently dimensioned to slightly squeeze or wedge the respective straps and to snugly hold them in the position just described. If the straps were not held sufficiently tightly, as the bag is loaded, the straps would slip to be more centered on the notches, thereby also closing the open end of the bag.

Also, the thickness of the straps is usually such that holding pressure is, in addition to the notches, provided by the force of the end pressing backwards against the wall. In this regard, note that when the strip is mounted by screws or in one of the adhesive manners previously described, the center of the strip flexes toward the wall as the ends are pulled forward for placing the straps of the bag in position. When the forward end pressures are released, the ends flex back toward the wall helped by the center flexing away from the wall, resulting in holding the straps in position to help the holding function provided by the notches.

Although the preferred material for strip 10 is plastic, metal or wood or other material having the qualities described above are acceptable.

In some instances, neither adhesive nor wood screws are preferred for mounting the strip. One such surface is sheetrock. In such case, molly bolts may be used with the screw holes in the place of screws to hold the strip to the mounting surface.

The exemplary dimensions referred to above are common. However, bags having straps that are set apart at a different distance from each other would require a compatible strip with compatibly separated top edge notches. The main dimension that makes a strip compatible is the notch spacing, which should be in the same range as the straps or bag handles. If the notches are much closer together than the handles, then the bag is bunched up undesirably. However, notches that are slightly further apart than the handles are usually quite acceptable.

While a single embodiment of the invention has been described and illustrated, although variations therefrom have been described, it will be understood that the invention is not limited thereto, since many modifications may be made and will become apparent to those skilled in the art.

For example, the top edge of the strip may include multiple notches at the end for accommodating to various spacings of handles or straps of bags that might be held by the inventive strip holder. All notches must be located away from the center or toward the respective ends from the respective standoff pads to permit the straps to be placed over the ends of the strip and into the notches. Also, the strip may be made of non-flexible material, if desired, since the pads will still provide enough space for slipping the bag straps over the end without having to flex the strip. Alternatively, the strip can be employed without pads 32 and 34 if it is flexible, since in such case the ends can be moved away from the mounting surface to permit the straps to slip over the end even though a surface-to-strip spacing is not preserved.

What is claimed is:

1. A holder for a plastic bag having at least first and second holding straps, comprising an elongate substantially straight and flat strip of slightly resilient material defining a first notch and a second notch in the upper edge of said strip, said first and second notches each opening upwardly and each being located adjacent respective extremities of said elongate strip, said first and second notches being spaced apart approximately the same distance as the first and second holding straps of said plastic bag;

first and second stand-off elements projecting rearwardly from said elongate strip and each being located adjacent to and toward the center of said elongate strip from respective ones of said first and second notches, said first and second stand-off elements adapted for contact with a vertical planar surface and spacing respective extremities of said elongate strip from said vertical planar surface; and means for securely affixing said elongate strip in a horizontal plane to a vertical planar surface in at least one location toward the center of said strip from said notches and said stand-off elements so that the first holding strap fits in said first notch and the second holding strap fits in said second notch.

2. A holder in accordance with claim 1 wherein said first and second stand-off elements are attached to the back of said strip between said first notch and said affixing means.

3. A holder in accordance with claim 1 or 2, wherein said affixing means includes at least two horizontally spaced apart screw holes being defined in said strip and screws for mounting said strip to said planar vertical surface.

4. A holder in accordance with claim 1 or 2, wherein said affixing means is at east one two-sided adhesive strip having one side thereof adhesively affixed to the back of said strip and located between said first and second notches and the other side thereof disposed for adhesive attachment to said vertical planar surface.

5. A holder in accordance with claim 1 or 2, wherein said affixing means includes at least two horizontally spaced apart screw holes being defined in said strip and molly bolts for mounting said strip to said vertical planar surface when said vertical planar surface is defined by a wall that is sheetrock.

6. A holder in accordance with claim 1 or 2, wherein the widths of said first and second notches are sufficiently small so as to respectively snugly hold the first and second holding straps of the plastic bag.

7. A holder in accordance with claim 1, wherein said elongate substantially straight and flat strip defines planar substantially parallel front and back surfaces and substantially parallel upper and lower edges, said upper edge being intersected by each of said upwardly opening first and second notches, said respective extremities of said strip being opposed extremities of said elongate substantially straight and flat strip and each being of rounded configuration to permit said first and second handle of said plastic bag to be slipped smoothly over said rounded extremities to respective first and second notches.

8. A holder for plastic bags having first and second holding straps, said holder comprising:

an elongate strip of material having an elongate substantially straight upper edge and defining opposed rounded extremities, said elongate strip defining upwardly opening notches located near respective extremities thereof and each intersecting said elongate substantially straight upper edge;

a pair of stand-off pads projecting rearwardly from said elongate strip of material and being located adjacent to and toward the center of said elongate strip of material from respective upwardly opening notches, said stand-off pads causing respective extremities of said elongate strip of material to be spaced from a vertical planar surface to which said strip is to be fixed; and said elongate strip of material further defining fixing means for securing said central portion of said elongate strip of material to said vertical planar surface, said fixing means being located adjacent to and toward the center of said elongate strip of material from respective stand-off pads.

9. A holder in accordance with claim 8 wherein said elongate strip of material is of substantially flat configuration defining substantially flat and parallel front and back surfaces and generally straight and parallel upper and lower edges, said first and second notches each intersecting said upper edge of said strip at equally spaced locations from respective extremities of said strip.

10. A holder in accordance with claim 9, wherein said respective extremities of said strip are of rounded configuration thus permitting said first and second holding straps of said plastic bag to slide over receptive extremities of said strip and to be received by respective first and second notches.

11. A holder in accordance with claim 10, wherein said fixing means includes a pair of screw holes being defined by said elongate strip of material and being located toward the center of said strip from respective stand-off pads.

12. A holder in accordance with claim 10 wherein said fixing means comprises at least one double sided adhesive member having one side thereof fixed to said back surface of said elongate strip of material and having the other side thereof exposed for adhesive attachment to said vertical planar surface.

13. A holder for plastic bags having first and second holding straps, said holder comprising:

(a) an elongate flat strip of material having elongate substantially straight and parallel upper and lower edges and defining opposed rounded extremities, said elongate strip defining upwardly opening notches located near respective extremities thereof and each intersecting said elongate substantially straight upper edge;

(b) a pair of stand-off pads projecting rearwardly from said elongate strip of material and being located adjacent to and toward the center of said elongate strip of material from respective upwardly opening notches, said stand-off pads causing respective extremities and said upwardly opening notches of said elongate strip of material to be spaced from a vertical planar surface to which said strip is to be fixed; and (c) said elongate strip of material further defining fixing means for securing said central portion of said elongate strip of material to said vertical planar surface, said fixing means being located adjacent to and toward the center of said elongate strip of material from respective stand-off pads.

14. A holder in accordance with claim 13 wherein said elongate strip of material is of substantially flat configuration defining substantially flat and parallel front and back surfaces and generally straight and parallel upper and lower edges, said first and second notches each intersecting said upper edge of said strip at equally spaced locations from respective extremities of said strip.

15. A holder in accordance with claim 14, wherein said respective extremities of said strip are of rounded configuration thus permitting said first and second holding straps of said plastic bag to slide over respective extremities of said strip and to be received by respective first and second notches.

16. A holder in accordance with claim 15, wherein said fixing means includes a pair of screw holes being defined by said elongate strip of material and being located toward the center of said strip from respective stand-off pads.

* * * * *